United States Patent [19]

Hazelet

[11] Patent Number: 4,756,043

[45] Date of Patent: Jul. 12, 1988

[54] GUTTER AND DOWNSPOUT CLEANER

[76] Inventor: James E. Hazelet, 453 Aurora Dr., Bricktown, N.J. 08723

[21] Appl. No.: 924,193

[22] Filed: Oct. 28, 1986

[51] Int. Cl.[4] ..... B08B 9/02

[52] U.S. Cl. ..... 15/104.16; 15/104.05; 401/137; 401/263; 401/289

[58] Field of Search ..... 15/104.03, 104.05, 104.1 R, 15/104.16, 104.2, 104.3 R, 104.3 SN; 134/8; 401/137, 261, 263, 289

[56] References Cited

U.S. PATENT DOCUMENTS

| | | | |
|---|---|---|---|
| 3,023,971 | 3/1962 | Milhous . | |
| 3,041,655 | 7/1962 | Entler . | |
| 3,908,910 | 9/1975 | Detwiler . | |
| 4,006,508 | 2/1977 | Brown | 15/104.05 |
| 4,168,559 | 9/1979 | Henson | 15/23 |
| 4,257,139 | 3/1981 | Yeo | 15/104.3 SN |
| 4,349,039 | 9/1982 | Egger | 134/167 C |
| 4,363,335 | 12/1982 | Tapper | 134/167 C |

*Primary Examiner*—Edward L. Roberts
*Attorney, Agent, or Firm*—Ralph W. Selitto, Jr.

[57] ABSTRACT

A gutter and/or downspout cleaner employs a water spray and a mechanical snake to break up and dislodge debris. The cleaner is sufficiently long so that an individual who is standing at ground level can arrange the water spray and snake above a gutter or downspout to be cleaned.

17 Claims, 2 Drawing Sheets

GUTTER AND DOWNSPOUT CLEANER

FIELD OF THE INVENTION

The present invention relates to apparatus for cleaning clogged debris, such as leaves and twigs, from gutters and downspouts, and, more particularly, to such apparatus which can be operated by an individual at ground. level.

BACKGROUND OF THE INVENTION

Gutters and downspouts are standard on almost every house in order to catch rainwater running off of an associated roof and then to divert the rainwater away from the house. However, in addition to rainwater, the gutters and downspouts also catch debris, such as leaves and twigs, which oftentimes clogs the gutters and downspouts. In order to unclog the gutters and downspouts of their houses, many homeowners have had to climb up to the clogged gutter or downspout and then manually dislodge the debris before flushing it out of the gutter or downspout with the water spray from a conventional garden hose.

U.S. Pat. Nos. 3,023,971; 3,041,655; 3,908,910; 4,349,039 and 4,363,335 relate to gutter and/or downspout cleaners which are designed to permit cleaning by a workman positioned on the ground. All of these devices are adapted for use with a conventional garden hose, whereby a water spray supplies the primary cleaning action. In many instances, the water spray alone is insufficient to unclog the gutters and downspouts. Although the devices disclosed in the '971 and '655 patents can be equipped with an attachment, such as a rake or a scraper blade, which assists in the cleaning operation, the additional cleaning action afforded by such attachments is limited.

SUMMARY OF THE INVENTION

The problems and disadvantages of the prior art devices discussed above are overcome in accordance with the present invention by providing a gutter and/or downspout cleaner with a mechanical agitator, as well as a fluid spray. The mechanical agitator is positioned, at least partially, within an elongated, rigid housing. By moving the agitator into and out of contact with clogged debris independently of any movement of the housing, the agitator can effectively cooperate with the fluid spray in dislodging the clogged debris from a gutter or a downspout.

In one embodiment, the agitator is a flexible snake mounted for reciprocating movement within the housing. The reciprocating movement of the snake can be achieved manually or semi-automatically through the use of a reel mounted on the housing. The fluid spray can be supplied with water from a conventional garden hose, which is connected to a conduit extending through or alongside the housing.

The housing is long enough so that the apparatus can be operated by a person at ground level. Thus, the present invention permits a gutter or downspout cleaning operation to be successfully performed without the use of ladders or similar equipment.

BRIEF DESCRIPTION OF THE DRAWINGS

For a better understanding of the present invention, reference is made to the following detailed description of an exemplary embodiment of the invention considered in conjunction with the accompanying drawings of same, in which.

DESCRIPTION OF THE EXEMPLARY EMBODIMENT

Figure 1:
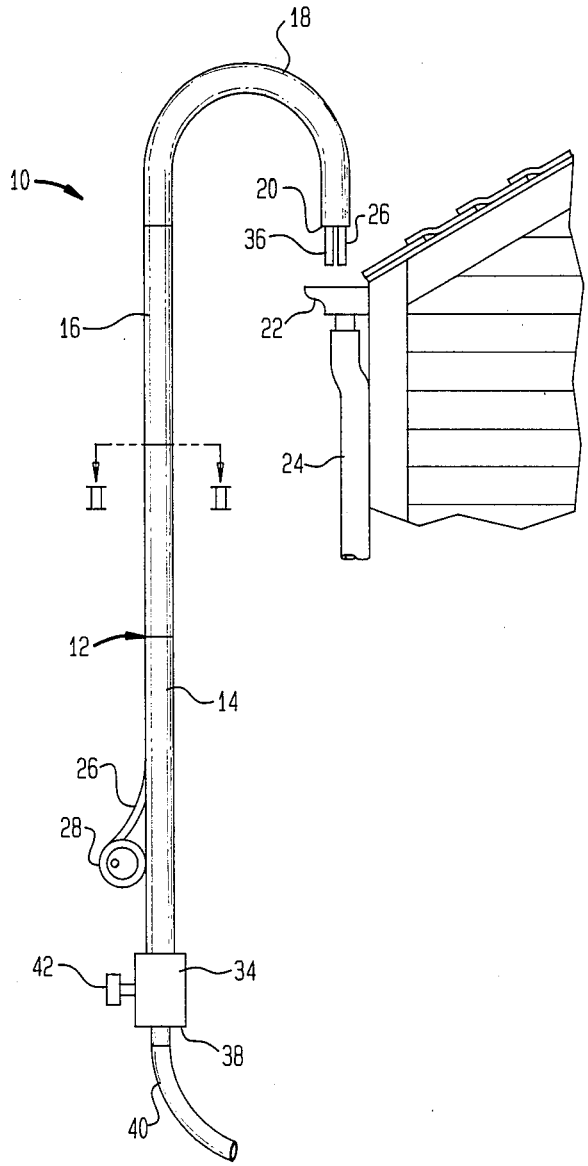
FIG. 1 is a side elevational view of an exemplary embodiment of a gutter and downspout cleaner constructed in accordance with the present invention, the gutter and downspout cleaner being shown in use.
Figure 2:
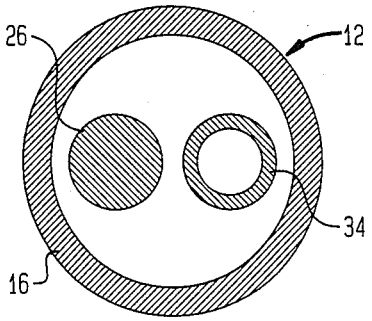
FIG. 2 is a cross-sectional view, taken along line II—II in FIG. 1 and looking in the direction of the arrows, of the gutter and downspout cleaner illustrated in FIG. 1.
Figure 3:
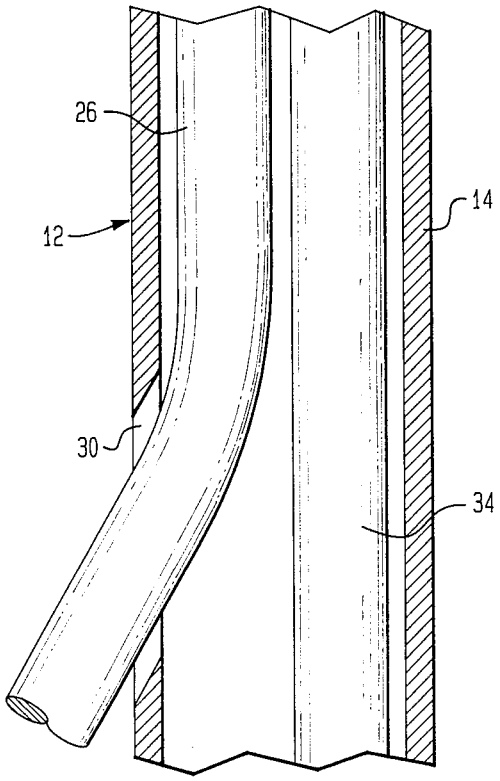
FIG. 3 is a cross-sectional view of a portion of the gutter and downspout cleaner illustrated in FIG. 1.

Referring to FIGS. 1–3, a gutter and downspout cleaner 10 includes a tubular housing 12 made from a rigid, lightweight material, such as aluminum. The housing 12 includes a straight lower section 14, a straight middle section 16 and a U-shaped upper section 18 which terminates in an outlet 20. The housing 12 is long enough to permit the outlet 20 of the upper section 18 to be positioned above a gutter 22 and a downspout 24 while the lower section 14 is held by an individual (not shown) located at ground level.

The middle section 16 is removably attached to the lower section 14 and to the upper section 18. Accordingly, if it is desired to increase the length of the housing 12, another section (not shown) can be added between the middle section 16 and the lower section 14 or the upper section 18.

A mechanical snake 26 is mounted for reciprocating movement within the housing 12. The reciprocating movement of the snake 26 is achieved semi-automatically by a reel 28 mounted on the lower section 14 of the housing 12. More particularly, the snake 26, which is wound on the reel 28, extends from the reel 28 into the lower section 14 of the housing 12 through an opening 30 provided in the lower section 14. After passing through the middle section 16 and the upper section 18, the snake 26 extends outwardly from the outlet 20 in order to cooperate in the performance of a debris unclogging operation which will be described in detail hereinafter. Although the snake 26 must be sufficiently rigid to perform such a debris unclogging operation, it must also be sufficiently flexible to conform to the shape of the upper section 18.

A conduit 32, which is made from copper or some other substantially rigid material, extends from a fitting 34 attached to the lower section 14 of the housing 12 through the lower, middle and upper sections 14, 16, 18, respectively, of the housing 12. The conduit 32 has a discharge end 36, which extends outwardly from the outlet 20 alongside the snake 26. The discharge end 36 of the conduit 32 is adapted to generate a fluid spray of sufficient force in order to cooperate in the performance of the debris unclogging operation which will be described in detail hereinafter.

The fitting 34 has an inlet 38 which is releaseably attached to a garden hose 40 or any other suitable source of fluid. A manually operable valve handle 42 regulates a valve (not shown) within the fitting 34 in order to control the flow of water or other fluid through the fitting 34 and into the conduit 32.

In operation, the lower section 14 of the housing 12 is held by an individual positioned at ground level who situates the upper section 18 such that the outlet 20 is located above the clogged gutter 22 or the downspout 24. The valve handle 42 can then be utilized to initiate a water spray from the discharge end 36 of the conduit 32. With the water spray impacting on the clogged debris in the gutter 22 or the downspout 24, the reel 28 is manually turned so as to wind and unwind the snake 26, thereby causing the snake 26 to reciprocate within the housing 12 and to move into and out of contact with the clogged debris. Thus, the agitating action of the snake 26 cooperates with the flushing action of the water spray discharged from the conduit 32 in order to dislodge the clogged debris from the gutter 22 or the downspout 24

It will be understood that the embodiment described herein is merely exemplary and that a person skilled in the art may make many variations and modifications without departing from the spirit and scope of the invention. All such variations and modifications are intended to be included within the scope of the invention as defined in the appended claims.

I claim:

1. Apparatus for cleaning clogged debris from gutters and downspouts, comprising an elongated, rigid housing, said housing having a first end and a second end, said second end being bent; spraying means for spraying a fluid at the clogged debris, said spraying means being at least partially coextensive with said housing; and agitating means positioned at least partially within said housing for mechanically agitating the clogged debris, said agitating means being movable relative to and independently of said housing such that said agitating means can be repeatedly moved into and out of contact with the clogged debris, and said agitating means including a flexible snake which is wound onto a manually-operable reel attached to said housing in the vicinity of said first end thereof and which is mounted for reciprocating movement within said housing such that said snake can be extended outwardly from said housing through said second end thereof and can be retracted into said housing through said second end thereof, whereby said spraying means and said agitating means cooperate to dislodge the clogged debris.

2. Apparatus according to claim 1, wherein said spraying means includes a conduit which is at least partially coextensive with said housing.

3. Apparatus according to claim 2, wherein said conduit extends through said housing to said second end thereof.

4. Apparatus according to claim 3, wherein said conduit extends outwardly from said second end of said housing.

5. Apparatus according to claim 2, further comprising connecting means for connecting said conduit to a source of fluid.

6. Apparatus according to claim 5, wherein said connecting means is located at said first end of said housing.

7. Apparatus according to claim 6, wherein said connecting means includes controlling means for controlling the flow of fluid through said conduit.

8. Apparatus according to claim 7, wherein said source of fluid is a conventional garden hose.

9. Apparatus according to claim 7, wherein said housing is made in sections, whereby the length of said housing can be varied.

10. Apparatus according to claim 9, wherein said second end of said housing is provided in a U-shaped section.

11. Apparatus according to claim 9, wherein the length of said housing is such that said second end of said housing can be positioned above a gutter or downspout while said housing is held by an individual located at ground level.

12. Apparatus for cleaning clogged debris from gutters and downspouts, comprising an elongated, rigid housing; spraying means for spraying a fluid at the clogged debris, said spraying means including a conduit extending within said housing; and agitating means positioned at least partially within said housing for mechanically agitating the clogged debris, said agitating means including a snake and a reel attached to said snake such that the rotation of said reel causes said snake to reciprocate relative to said housing, whereby said snake can be repeatedly moved into and out of contact with the clogged debris to thereby cooperate with said spraying means in breaking up and dislodging the clogged debris.

13. Apparatus according to claim 12, wherein said conduit and said snake extend outwardly from an outlet end of said housing.

14. Apparatus according to claim 13, wherein said housing is made in sections, said outlet end being provided in a U-shaped section.

15. Apparatus according to claim 14, further comprising connecting means for connecting said conduit to a conventional garden hose.

16. Apparatus according to claim 15, further comprising controlling means for controlling the flow of water through said conduit.

17. Apparatus according to claim 16, wherein the length of said housing is such that said outlet end can be positioned above a gutter or downspout while said housing is held by an individual located at ground level.

* * * * *